US011197552B2

(12) United States Patent
Piretti

(10) Patent No.: US 11,197,552 B2
(45) Date of Patent: Dec. 14, 2021

(54) FLEXIBLE BACKREST FOR A FOLDING CHAIR, AND FOLDING CHAIR COMPRISING THIS BACKREST

(71) Applicant: Pro-Cord S.p.A., Bologna (IT)

(72) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 0 days.

(21) Appl. No.: 16/920,899

(22) Filed: Jul. 6, 2020

(65) Prior Publication Data

US 2021/0007493 A1 Jan. 14, 2021

(30) Foreign Application Priority Data

Jul. 8, 2019 (IT) ..... IT102019000011166

(51) Int. Cl.

| | |
|---|---|
| ***A47C 4/00*** | (2006.01) |
| ***A47C 4/02*** | (2006.01) |
| ***A47C 4/28*** | (2006.01) |
| ***A47C 5/12*** | (2006.01) |
| ***A47C 7/46*** | (2006.01) |
| ***A47C 7/44*** | (2006.01) |
| *A47C 4/04* | (2006.01) |

(52) U.S. Cl.

CPC ..... *A47C 7/44* (2013.01); *A47C 7/46* (2013.01); *A47C 4/04* (2013.01)

(58) Field of Classification Search

CPC ..... A47C 4/04; A47C 7/44; A47C 7/46
USPC ..... 297/22, 23, 55, 56, 284.1, 284.2, 284.3, 297/452.15, 452.63, 440.21
See application file for complete search history.

(56) References Cited

U.S. PATENT DOCUMENTS

| | | | | | |
|---|---|---|---|---|---|
| 219,589 | A * | 9/1879 | Mayo | A47C 3/12 | 297/452.15 |
| 2,530,924 | A * | 11/1950 | Turner | A47C 7/405 | 297/452.15 |
| 3,203,734 | A * | 8/1965 | Seymer | A47C 7/028 | 297/452.63 |
| 4,856,846 | A * | 8/1989 | Lohmeyer | A47C 3/12 | 297/452.15 X |
| 4,892,356 | A * | 1/1990 | Pittman | A47C 3/12 | 297/452.15 |
| 5,123,702 | A * | 6/1992 | Caruso | F16B 5/0685 | 297/440.21 |

(Continued)

FOREIGN PATENT DOCUMENTS

| | | | | |
|---|---|---|---|---|
| DE | 19526437 A1 * | 1/1997 | ..... | A47C 1/032 |
| EP | 0020137 A1 | 12/1980 | | |

(Continued)

OTHER PUBLICATIONS

International Search Report dated Nov. 21, 2019. 7 pages.
Italian Search Report dated Nov. 21, 2019. 7 pages.

*Primary Examiner* — Rodney B White
(74) *Attorney, Agent, or Firm* — RMCK Law Group PLC

(57) ABSTRACT

A flexible backrest for a folding chair includes a flexible backrest panel which can assume a curved configuration of use and an extended storage configuration. The flexible backrest panel has a support surface having a concave shape in a cross-section in a horizontal plane, and a convex shape in a cross-section in a vertical plane; and the flexible backrest panel has a plurality of vertical through-slits forming a plurality of vertical slats.

7 Claims, 6 Drawing Sheets

(56) References Cited

U.S. PATENT DOCUMENTS 5,154,485 A * 10/1992 Fleishman ..... A47C 7/028 297/452.15 X
5,524,966 A * 6/1996 Piretti ..... A47C 4/14 297/55 X
5,664,835 A * 9/1997 Desanta ..... A47C 7/024 297/452.15 X
6,409,268 B1 * 6/2002 Cvek ..... A47C 7/405 297/452.15 X
6,481,789 B1 * 11/2002 Ambasz ..... A47C 1/121 297/55 X
6,616,223 B1 * 9/2003 Lin ..... A47C 4/44 297/55 X
6,742,839 B2 * 6/2004 Piretti ..... A47C 3/04 297/55 X
6,755,467 B1 6/2004 Chu
7,017,986 B2 * 3/2006 Degen ..... A47C 4/20 297/447.2
7,052,081 B2 * 5/2006 Leng ..... A47C 3/045 297/58
7,156,459 B2 * 1/2007 Ambasz ..... A47C 1/03 297/239
7,753,439 B2 * 7/2010 Akkad ..... A47C 4/10 297/23
7,758,112 B2 * 7/2010 Huang ..... A47C 4/025 297/23
7,971,935 B2 * 7/2011 Saez ..... A47C 7/029 297/452.15 X
8,029,059 B2 * 10/2011 Smith ..... A47C 3/04 297/55 X
8,033,598 B2 * 10/2011 Smith ..... A47C 4/44 297/55
8,033,612 B2 * 10/2011 Smith ..... A47C 3/04 297/55 X
8,038,221 B2 * 10/2011 Smith ..... A47C 7/282 297/55 X
8,317,269 B2 * 11/2012 Smith ..... A47C 3/04 297/440.11
8,322,787 B2 * 12/2012 Smith ..... A47C 4/28 297/239
D676,254 S 2/2013 Chen
8,454,093 B2 * 6/2013 Smith ..... A47C 4/48 297/55 X
8,506,008 B2 * 8/2013 Pan ..... A47C 7/546 297/55
8,721,003 B2 * 5/2014 Waite ..... A47C 4/22 297/440.21
8,820,835 B2 * 9/2014 Minino ..... A47C 7/44 297/296
8,851,561 B2 * 10/2014 Huang ..... A47C 4/24 297/55
8,876,209 B2 * 11/2014 Peterson ..... A47C 7/44 297/284.1
9,192,237 B2 * 11/2015 Bachar ..... A47C 7/46
9,717,343 B1 * 8/2017 Pan ..... A47C 7/746
9,826,838 B2 * 11/2017 Piretti ..... A47C 5/04
9,913,537 B2 * 3/2018 Piretti ..... A47C 5/10
10,058,185 B2 * 8/2018 Naik ..... A47C 7/448
10,064,491 B2 * 9/2018 Piretti ..... A47C 5/10
10,292,499 B1 * 5/2019 Liu ..... A47C 7/445
10,588,414 B2 * 3/2020 Olarte ..... A47C 7/622
10,791,842 B2 * 10/2020 Peterson ..... A47C 7/445
2001/0033100 A1 * 10/2001 Haney ..... A47C 4/20 297/55
2003/0168894 A1 * 9/2003 Lin ..... A47C 4/48 297/55
2005/0012370 A1 * 1/2005 Krawchuck ..... A47C 3/04 297/23 X
2005/0206202 A1 * 9/2005 Winter ..... A47C 1/03 297/23
2007/0267912 A1 * 11/2007 Britton ..... A47C 7/024 297/452.49
2009/0140568 A1 * 6/2009 Chan ..... A47C 7/40 297/452.63 X
2013/0038110 A1 * 2/2013 Deisig ..... A47C 7/445 297/354.12
2013/0127219 A1 * 5/2013 Gerwig ..... A47C 7/46 297/284.3
2013/0187422 A1 * 7/2013 Schwinghammer ..... A47C 3/04 297/239
2015/0230614 A1 * 8/2015 Leng ..... A47C 4/10 297/56
2016/0157615 A1 * 6/2016 Piretti ..... A47C 7/44 297/301.1
2017/0164746 A1 * 6/2017 Phillips ..... A47C 7/185
2017/0224119 A1 8/2017 Peterson et al.
2018/0116403 A1 * 5/2018 Tsai ..... A47C 3/04
2019/0142168 A1 * 5/2019 Liu ..... A47C 7/46 297/301.1

FOREIGN PATENT DOCUMENTS

EP 2133007 A1 * 12/2009 ..... A47C 7/425
EP 3189751 A1 7/2017
KR 2019094507 A * 9/2019 ..... A47C 7/44

* cited by examiner

FLEXIBLE BACKREST FOR A FOLDING CHAIR, AND FOLDING CHAIR COMPRISING THIS BACKREST

CROSS-REFERENCE TO RELATED APPLICATION

This application claims priority to Italian Patent Application No. 102019000011166 filed Jul. 8, 2019. The disclosure of the above application is incorporated herein by reference in its entirety.

FIELD OF THE INVENTION

The present invention relates to a flexible backrest for a folding chair. According to another aspect, the invention also relates to a folding chair comprising such a flexible backrest.

DESCRIPTION OF THE PRIOR ART

Generally, folding chairs have a backrest with reduced dimensions. It would be desirable to increase the height of the backrest of folding chairs to provide greater comfort to the user, in particular to provide support for the lumbar area.

However, often it is not possible to increase the height of the backrest because with a backrest with greater dimensions, in the storage configuration, the backrest would be at least partially overlapped to the seat, and this would increase the volume of the chair in the storage configuration.

EP-A-3189751 by the same applicant describes a folding chair comprising a flexible backrest panel and two backrest supports, which engage the opposite side edges of the backrest panel. The two backrest supports are movable in a transverse direction between a close position corresponding to the position of use and a spaced apart position corresponding to the storage position.

The movement in the transverse direction of the backrest supports modifies the curvature of the backrest panel between an arched position of use and an extended position of storage. This solution has proved to be very advantageous in providing a wide and comfortable backrest in the condition of use and with reduced dimensions in the storage configuration.

One of the limitations of this solution is that, in order to allow the deformation of the backrest panel between the extended storage position and the arched position of use, the backrest support surface must have a single curvature. In particular, in order to have a backrest capable of assuming a curved configuration and an extended position, it is not possible to provide a lumbar support portion on the backrest, anatomically shaped to the lumbar area of the user. In fact, to form an effective lumbar support on the backrest panel it would be necessary to provide a convex zone, that is, with an opposite curvature to the curvature of the remaining part of the backrest. A backrest panel having areas with different curvatures would be substantially non-deformable and could not assume a curved position of use and an extended position of storage.

OBJECT AND SUMMARY OF THE INVENTION

The present invention aims to provide a backrest for a folding chair that can assume a curved position of use and an extended storage position, and that has a support surface with improved comfort.

According to the present invention, this object is achieved by a flexible backrest having the characteristics forming the subject of claim 1.

According to another aspect, the invention relates to a folding chair having the characteristics that form the subject of claim 5.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
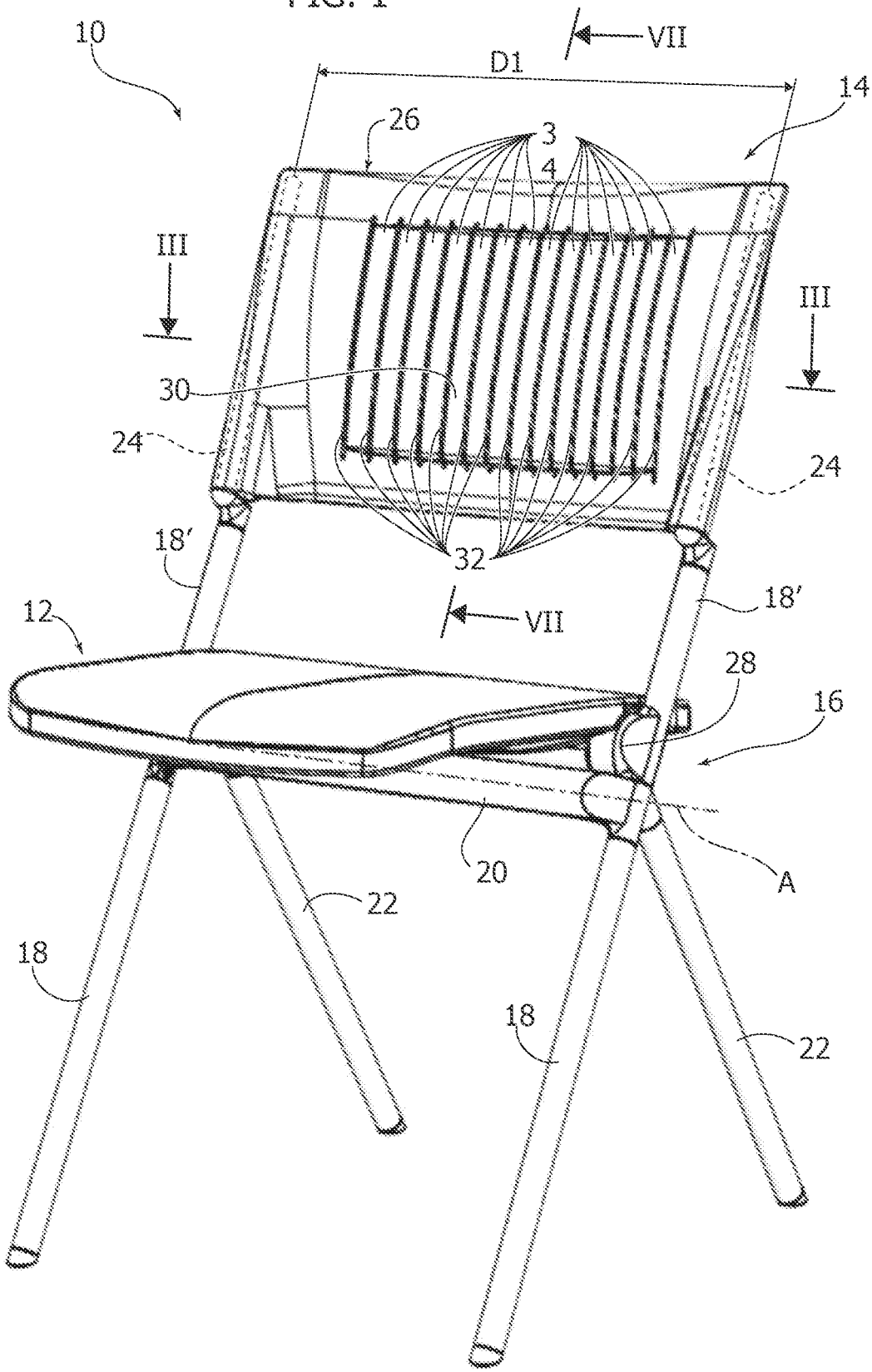
FIG. 1 is a perspective view of a folding chair in the configuration of use.
Figure 2:
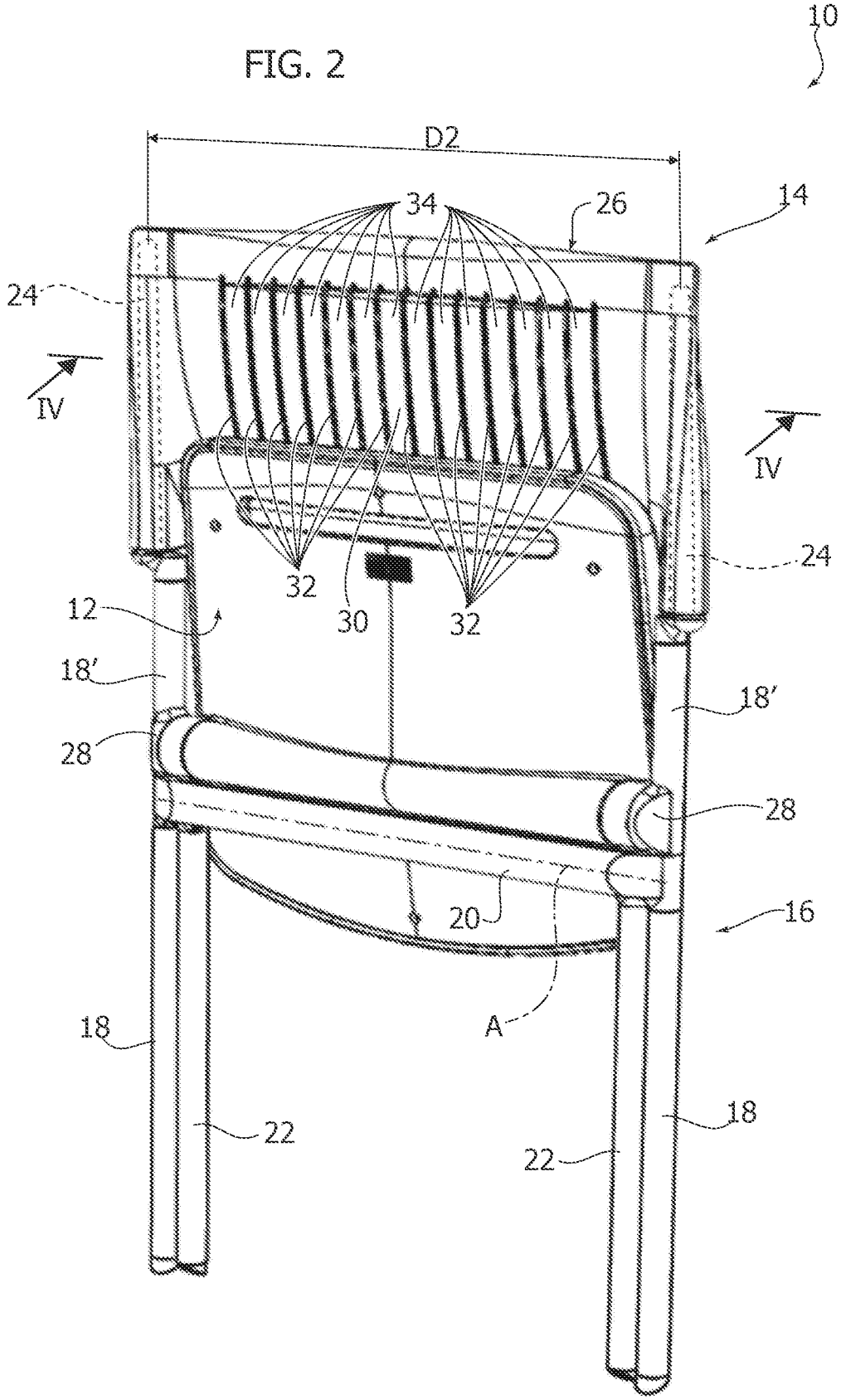
FIG. 2 is a perspective view of the folding chair of FIG. 1, in the storage position.

With reference to FIGS. 1 and 2, numeral 10 indicates a folding chair capable of assuming a configuration of use—illustrated in FIG. 1—and a storage configuration, illustrated in FIG. 2. The chair 10 comprises a seat 12, a backrest 14, and a folding frame 16 that carries the seat 12 and the backrest 14.

In a possible embodiment, the folding frame 16 comprises a pair of front legs 18 joined together by a transverse element 20, and a pair of rear legs 22 articulated to the transverse element 20 around a transverse axis A. The front legs 18 have respective upper portions 18' which extend above the articulation axis A. The upper portions 18' of the front legs 18 carry respective backrest supports 24.

The backrest 14 comprises a flexible backrest panel 26 having two side edges, which engage the respective backrest supports 24. The backrest panel 26 may be made of elastically deformable plastic material, for example nylon. The backrest panel 26 may have side edges with a tubular shape into which the respective backrest supports 24 are inserted.

The backrest supports 24 are movable with respect to the upper portions 18' of the front legs 18 between a close position of use and a spaced apart storage configuration. In the configuration of use (FIG. 1) the distance between the backrest supports 24 is equal to D1. In the storage configuration (FIG. 2) the distance between the backrest supports 24 is equal to D2, which is greater than the distance D1. Therefore, the flexible backrest panel 26 is stretched in the transverse direction when the chair changes from the configuration of use to the storage configuration. Consequently, the flexible backrest panel 26 passes from a curved configuration in the configuration of use to an extended configuration in the storage configuration.

In a possible embodiment, the backrest supports 24 may be eccentric with respect to the upper portions 18' of the legs 18, and may be rotatable around the axes of the upper portions 18' to move from the close position of FIG. 1 to the spaced apart position of FIG. 2.

In a possible embodiment, the seat 12 may be connected to the upper portions 18' of the front legs 18 by means of a pair of joints 28 that connect the seat 12 to the frame 16 in an articulated way around a transverse axis, so that the seat 12 is movable between a lowered position of use and a raised position of storage. In a possible embodiment, transmission mechanisms can be housed inside the joints 28, which control the movement of the backrest supports 24 between the close position and the spaced apart position, and vice versa, according to the pivoting of the seat 12 between the lowered position and the raised position, and vice versa. The transmission mechanisms that control the movement of the backrest supports 24 according to the position of the seat can be made as described in document EP-A-3189751 by the same applicant.

The backrest panel 26 has a support surface 30 against which, during use, the user's back rests. In the configuration of use, the support surface 30 may have a concave shape in a cross-section in a horizontal plane, and may have a convex shape in a cross-section in a vertical plane, so as to anatomically adapt to the user's back. In particular, the support surface 30 may have a convex shape in the lower part of the backrest panel 26 to form a lumbar support.

The support surface 30 with two opposing curvatures (a concave curvature in a horizontal plane and a convex curvature in a vertical plane) does not allow deformation of the backrest panel 26 between the curved configuration of use and the extended storage configuration. To allow deformation of the backrest panel 26 between the position of use and the storage position, and vice versa, the backrest panel 26 comprises a plurality of vertical through-slits 32, parallel to each other, which extend for a considerable part of the height of the backrest panel 26. The through-slits 32 subdivide the support surface 30 of the backrest panel 26 into a plurality of vertical slats 34 parallel to each other. The vertical slats 34 may have respective front surfaces with a convex shape in a vertical plane.

Figure 3:
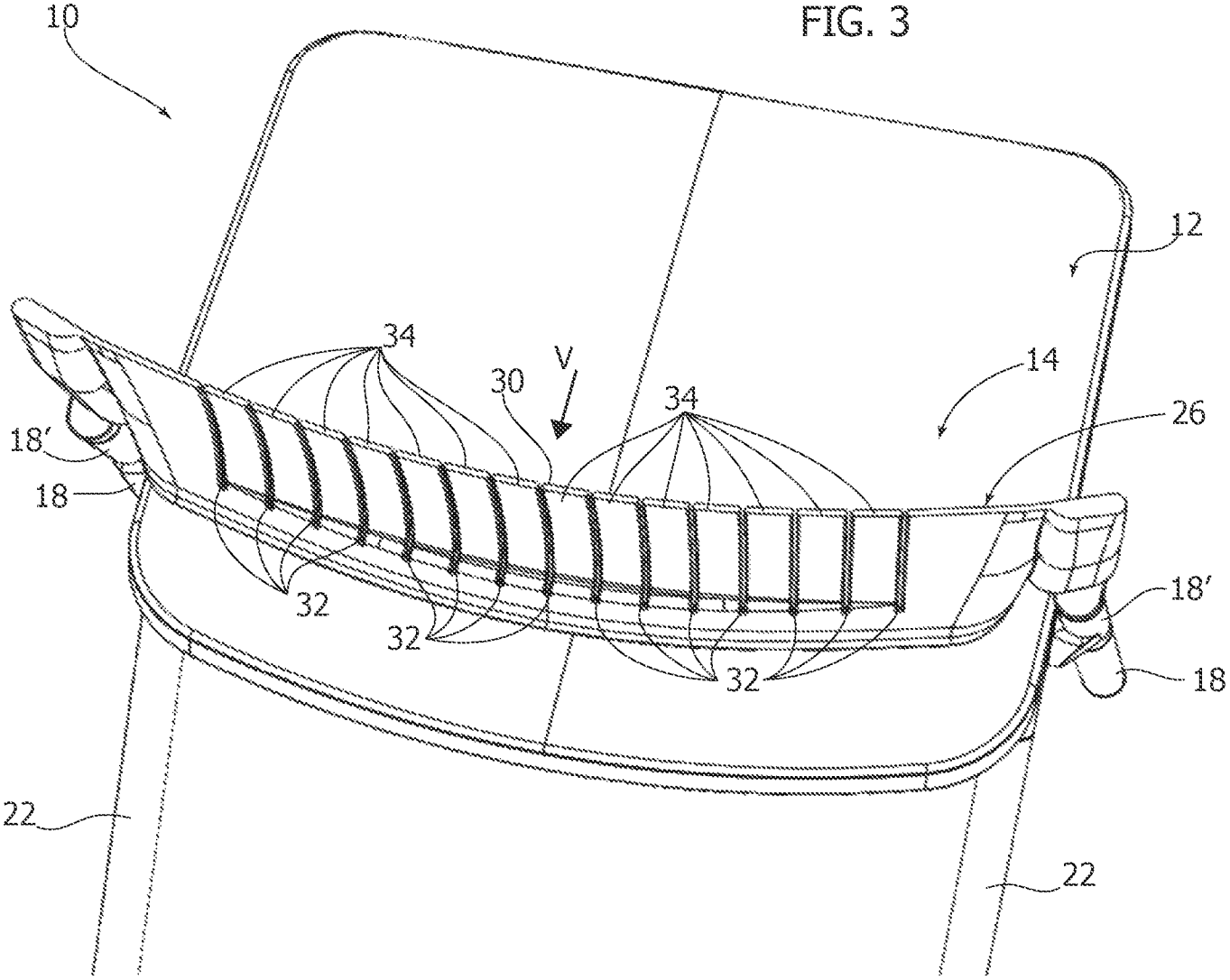
FIGS. 3 and 4 are partially cross-sectioned perspective views according to the lines III-III and IV-IV of FIGS. 1 and 2, respectively.
Figure 4:
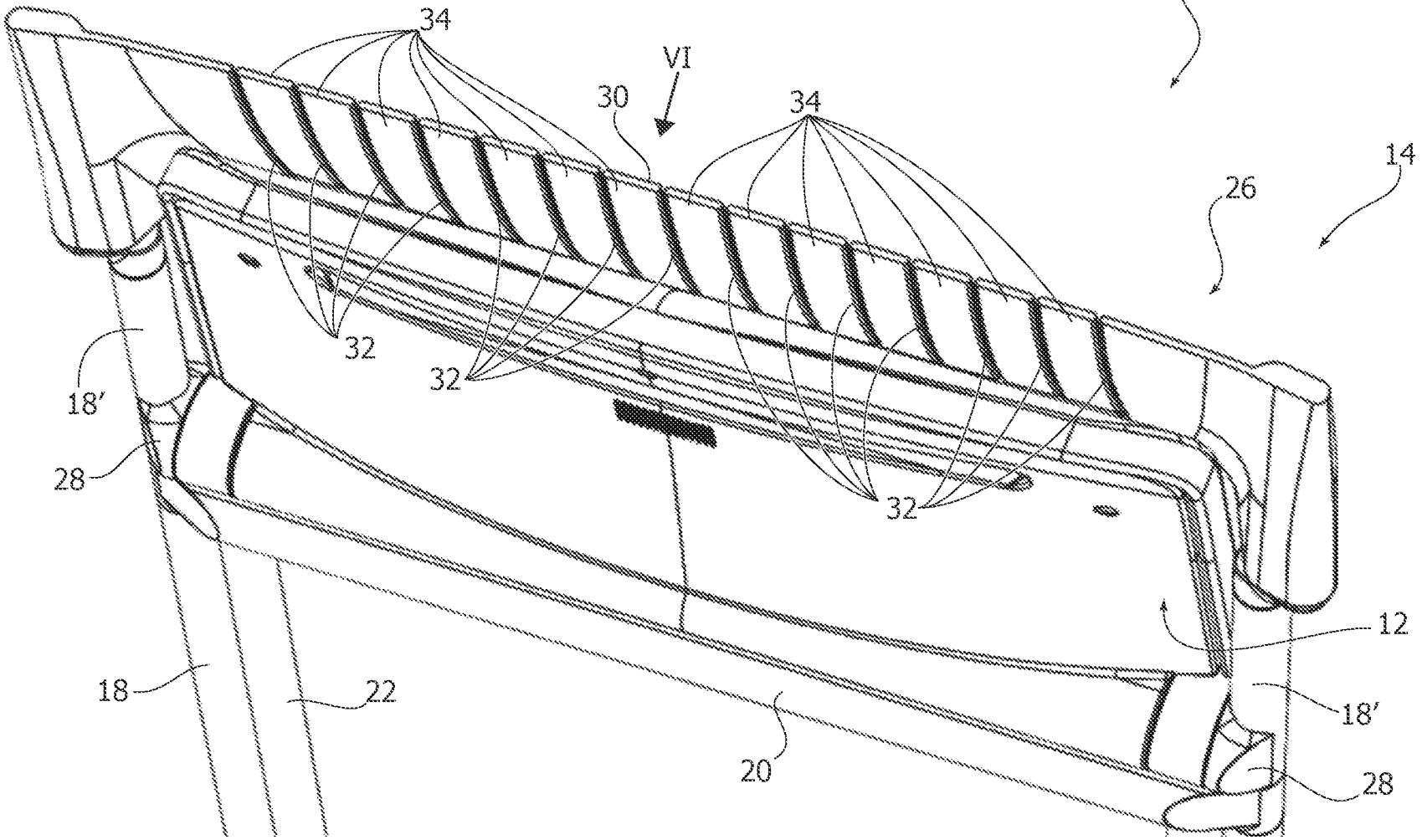

The vertical slats 34 are substantially free to deform with respect to each other thanks to the vertical slits 32. Therefore, the backrest panel 26 is free to deform between the curved configuration of use illustrated in FIGS. 1, 3 and 5 and the extended storage configuration illustrated in FIGS. 2, 4 and 6.

Figure 5:
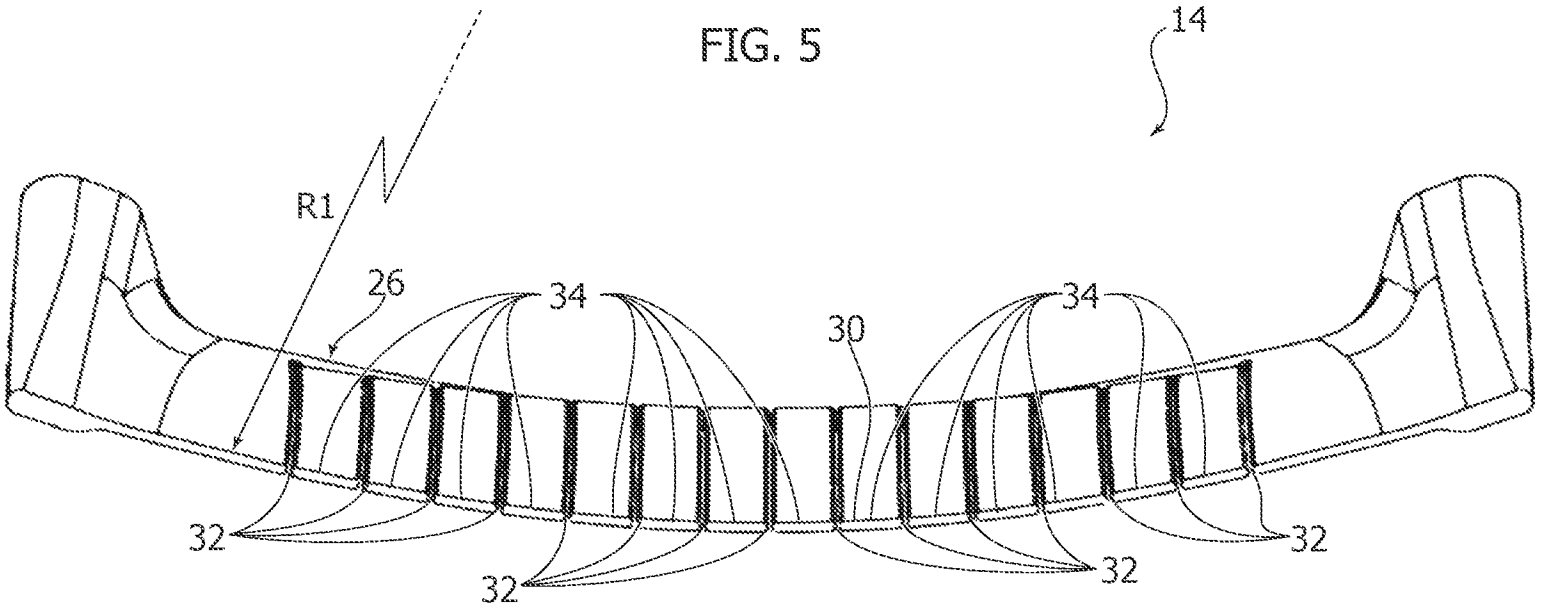
FIGS. 5 and 6 are plan views, respectively, according to the arrows V and VI of FIGS. 3 and 4.
Figure 6:
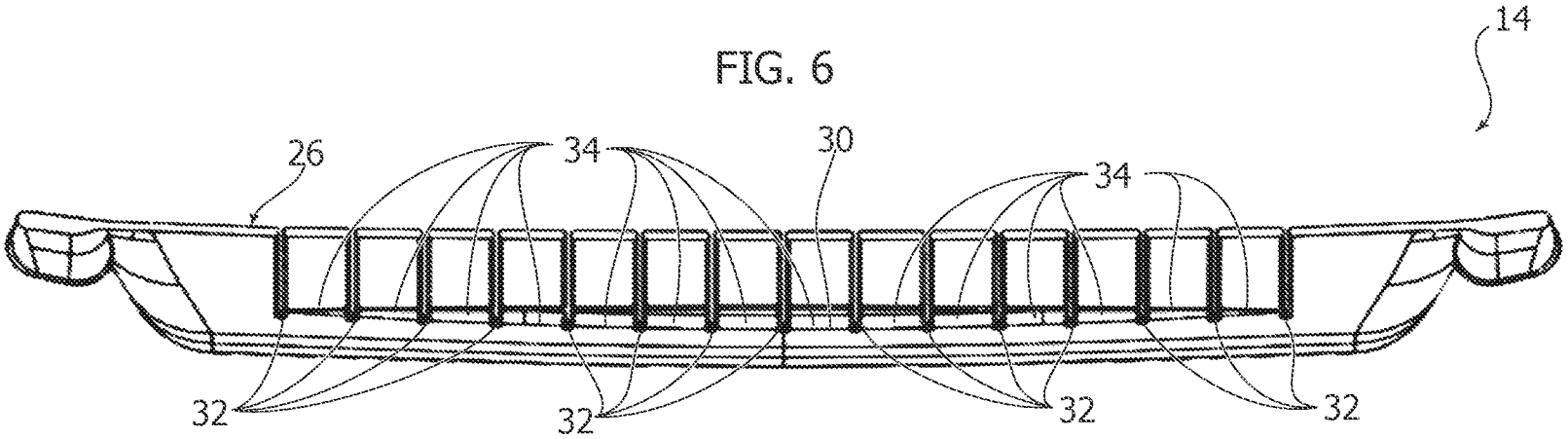
Figure 7:
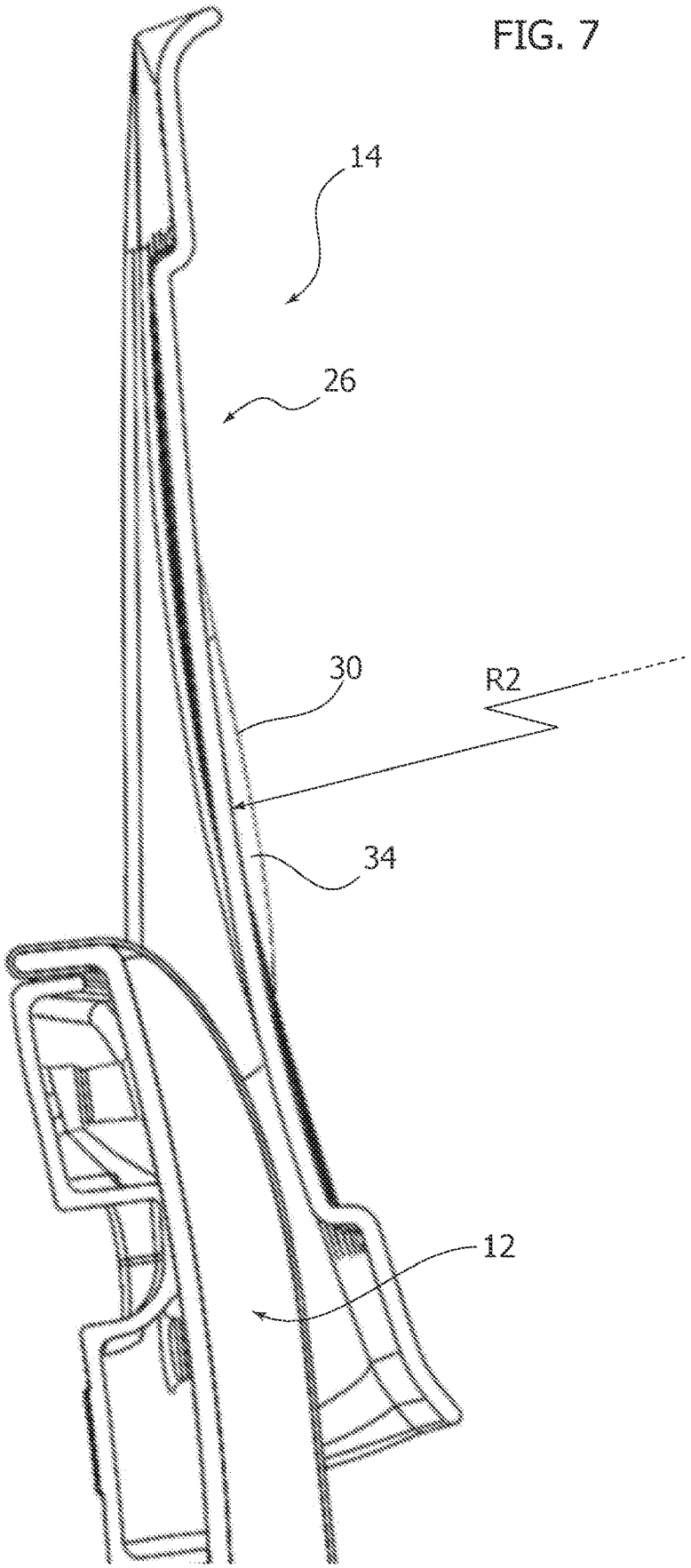
FIG. 7 is a cross-section along the line VII-VII of FIG. 1.

The opposite curvature in perpendicular planes of the support surface 30 can be appreciated with reference to the cross-sections of FIGS. 5 and 7. FIG. 5, which shows a cross-section in a horizontal plane, shows that the support surface 30 is concave and has a curvature R1 whose center is located in front of the backrest panel 26. FIG. 7, which shows a cross-section in a vertical plane, shows that the same support surface is convex, and has a curvature R2 whose center is located behind the backrest panel 26.

Thanks to the aforesaid characteristics, the backrest 14 can offer improved comfort characteristics thanks to the possibility of providing the backrest panel 26 with a convex area for lumbar support, while maintaining the flexibility necessary to assume a curved position of use and an extended storage position.

Of course, without prejudice to the principle of the invention, the details of construction and the embodiments can be widely varied with respect to those described and illustrated, without thereby departing from the scope of the invention as defined by the claims that follow.

The invention claimed is:

1. A flexible backrest for a folding chair, comprising:

a flexible backrest panel having a support surface with a concave shape in a cross-section in a horizontal plane, and a convex shape in a cross-section in a vertical plane, wherein the backrest panel has a plurality of vertical through-slits forming a plurality of vertical slats, wherein the flexible backrest panel has two side edges with a tubular shape into which respective backrest supports are inserted, said backrest supports being movable between a configuration of use and a storage configuration, wherein in the configuration of use, a distance between the backrest supports has a first dimension and in the storage configuration, the distance between the backrest supports has a second dimension which is greater than said first dimension, so that the flexible backrest panel is stretched in a transverse direction of the chair when the backrest supports move from the configuration of use to the storage configuration, and assumes a curved configuration in the configuration of use and an extended stretched configuration in the storage configuration.

2. The backrest of claim 1, wherein in the curved configuration of use, the support surface in the cross-section in the horizontal plane has a curvature with a first radius whose center is located in front of the flexible backrest panel, and in a cross-section in a vertical plane has a second curvature whose center is located behind the flexible backrest panel.

3. The backrest of claim 1, wherein said vertical slats have respective convex front surfaces.

4. A folding chair comprising:

a frame including a pair of front legs and a pair of rear legs articulated to each other around a transverse axis, a seat movable relative to the frame between a lowered position and a raised position, a pair of backrest supports movable between a closed position and a spaced apart position, and a backrest comprising a flexible backrest panel having a curved configuration of use and an extended storage configuration, wherein:

the flexible backrest panel has a support surface having a concave shape in a cross-section in a horizontal plane, and a convex shape in a cross-section in a vertical plane, the flexible backrest panel has a plurality of vertical through-slits forming a plurality of vertical slats, the flexible backrest panel is fixed to said pair of backrest supports, and in the curved configuration of use of the flexible backrest panel, a distance between the backrest supports has a first dimension and in the extended storage configuration, the distance between the backrest supports has a second dimension which is greater than said first dimension, such that the flexible backrest panel is stretched in a transverse direction of the chair when the backrest panel assumes the extended storage configuration from the configuration of use.

5. The chair of claim 4, wherein the pair of front legs have respective upper portions that extend above said transverse axis and that carry respective backrest supports of the pair of backrest supports.

6. The chair of claim 5, wherein said pair of backrest supports are eccentric with respect to the respective upper portions of the pair of front legs and are rotatable about respective axes between the closed position and the spaced apart position, and vice versa.

7. The chair of claim 6, wherein the seat is connected to the frame by a pair of joints and said joints are connected to respective transmission mechanisms, which control movement of said pair of backrest supports between the closed position and the spaced apart position, and vice versa, according to movement of the seat from the lowered position to the raised position, and vice versa.

* * * * *